US006674455B2

(12) United States Patent
Harris

(10) Patent No.: US 6,674,455 B2
(45) Date of Patent: Jan. 6, 2004

(54) APPARATUS AND METHOD FOR PRINTING TWO COLORS IN A SINGLE PASS USING THERMALLY SENSITIVE DIRECT AND TRANSFER MEDIA

(75) Inventor: Richard Hunter Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 16 days.

(21) Appl. No.: 10/115,560

(22) Filed: Apr. 3, 2002

(65) Prior Publication Data

US 2003/0189630 A1 Oct. 9, 2003

(51) Int. Cl.[7] ..... B41J 2/32
(52) U.S. Cl. ..... 347/171
(58) Field of Search ..... 347/171, 174, 347/177, 178, 217, 187; 503/227; 400/120.1, 120.02, 120.13, 120.04, 124.02, 124.05, 611, 612, 613

(56) References Cited

U.S. PATENT DOCUMENTS 4,250,511 A 2/1981 Stein et al.
4,672,393 A 6/1987 Uchikata et al.
5,247,313 A 9/1993 Oosaka et al. ..... 347/172
5,266,972 A 11/1993 Gotho et al.
5,305,020 A * 4/1994 Gibbons et al. ..... 347/177
5,629,259 A * 5/1997 Akada et al. ..... 503/227
6,010,258 A * 1/2000 Tomita et al. ..... 400/120.02
6,140,513 A 10/2000 Iida
6,222,575 B1 * 4/2001 Liu et al. ..... 347/217

* cited by examiner

*Primary Examiner*—Lamson Nguyen
*Assistant Examiner*—K. Feggins
(74) *Attorney, Agent, or Firm*—J. Bruce Schelkopf

(57) ABSTRACT

A thermal printing mechanism prints a black pattern on a paper web with a direct printing process and additionally prints a color pattern on the paper web with a transfer printing process. The paper web and a transfer film web are moved between a platen and a thermal printhead, with the transfer film web between the paper web and the printhead, with heating elements within the printhead being operated at one temperature to produce the color pattern and at another, higher temperature to produce the black pattern. Preferably, the transfer film web is moved only when the color pattern is being printed and when it is otherwise necessary to prevent the film web from being worn through as the black pattern is printed.

5 Claims, 2 Drawing Sheets

APPARATUS AND METHOD FOR PRINTING TWO COLORS IN A SINGLE PASS USING THERMALLY SENSITIVE DIRECT AND TRANSFER MEDIA

BACKGROUND OF THE INVENTION

1. Field of the Invention

This invention relates to a two-color printing process, and more particularly, to a method for carrying out a two-color printing process within a thermal printer suitable for use in a point-of-sale environment.

2. Background Art

A thermal printer conventionally employs a single printhead to print on a paper web moved past the printhead. The printhead includes number of pixel-sized heating elements extending in a line across the width of the paper web, arranged to contact the paper web. The heating elements are individually electrically driven in a pattern used to produce the desired printed image.

Printing within a conventional thermal printer is by either a direct or a transfer process. In the direct process, the paper is coated with a material which changes color, typically turning black, upon the application of heat. (Black is herein referenced as a "color," since it is formed by printing processes which can alternately be used to produced an individual color.) Thus, a black pattern is typically formed on the surface of the paper in accordance with the pattern in which the heating elements are driven as the paper is moved past the printhead.

On the other hand, in the transfer process, a film web, lying between the paper web and the printhead, is moved with the paper web. The film web includes a coating, lying next to the paper, which is locally softened and transferred to the paper in response to an application of heat. Thus, this coating, which again is typically black, is removed according to the pattern in which the heating elements are driven, to be transferred to the adjacent paper surface, forming the printed image.

The main advantage of the direct process is its simplicity compared to the transfer process. The main advantage of the transfer process is that it produces a document on plain paper, having a better surface "feel" and being insensitive to heat. The main disadvantage of the transfer process is its cost, since the additional film ribbon web is more expensive than the coated paper. Also the web, which is rapidly used up, since it must move with the paper during printing, becomes another item to be stocked, replaced, and disposed during operation of the printer.

Because of its relative simplicity and low cost, the direct process is typically used for point-of-sale printers to print receipts and other documents rapidly and quietly, without the noise typically associated with impact printers in this application. At the point of sale, frequent replacement of supplies, such as film web, under the conditions of busy sales terminals and waiting lines, would be considered a serious disadvantage of the conventional transfer process. Additionally, the relatively small size of most receipts tends to eliminate objections to physical characteristics of the coated paper. Because documents received from facsimile transmissions are generally the size and shape of letter-size paper, because such documents are often filed with other documents of similar size and shape, and because of a longstanding level of general dissatisfaction with coated and tightly rolled paper for printing facsimile transmissions, the use of the transfer process with plain, letter-size paper is gaining wide acceptance in facsimile machines.

In the point-of-sale environment, what is needed is a method for using color to highlight specific information on a sales receipt, such as the total or amount due, so that such information can quickly be found in a list of numbers. Additionally, other information, such as advertising slogans or logos, printed on receipts may advantageously be highlighted using color. One method for providing such information highlighting involves returning to the conventional impact printer with a two color (typically red and black) ribbon. However, this method requires relinquishing the advantages of thermal printing in this environment, such as quiet operation, improved reliability with fewer moving parts, and a print quality that does not deteriorate over the life or a conventional ink ribbon.

In thermal printing, both the direct process and the transfer process can be modified to produce multicolor printed images. For example, U.S. Pat. No. 6,140,513 describes a recording material for use in the direct process of a two-color forming heat-sensitive system. The recording material has a single recording layer that forms at least two colors with a single kind of dye precursor experiencing changes in its chemical structure according to a level of heat energy applied to the recording layer.

A printer using the thermal transfer process to produce two or more colors is described in U.S. Pat. No. 4,672,393. The transfer film is formed as a ribbon having two or more layers, each of which has a different color and a different melting point, with the outermost layer, which is moved adjacent the recording paper on which printing is to occur, having the lowest melting point, and with the innermost layer, which lies against the film base of the ribbon, having the highest melting point. Thus, the number of layers transferred to the recording paper, and hence the color of the image formed by printing, is varied by changing the temperature of the heating elements within the printhead of the printer.

The principle disadvantage of each of these methods lies in the cost of its associated materials when compared to the single-color direct printing process. A direct printing thermal paper producing two colors is known to be substantially more expensive than conventional, single-color direct thermal printing papers. Even the single-color transfer process is known to require more expensive materials than the single-color direct printing process, and to require the disruption of frequent replacement of the thermal printing film cartridge. Therefore, in the point-of-sale environment, what is needed is a thermal printer capable of providing color highlighting, with the vast majority of the material being printed in black, without providing a substantial penalty in terms of materials cost or in terms of a frequent need to replace materials, due to the relatively infrequent use of a highlighting color.

The patent literature also includes descriptions of several thermal printing processes which print the subtractive primary colors, yellow, cyan, and magenta, in a manner causing their combination to represent any color. Such methods are too complex, expensive, and slow to be competitive for printing receipts in the point-of-sale environment. For example, U.S. Pat. No. 5,247,313 describes a direct thermal process in which the three layers are printed sequentially, with each layer being fixed to prevent further printing of its color after it is printed. U.S. Pat. Nos. 4,250,511 and 5,266,272 describe transfer thermal processes in which using a transfer film coated with transversely extending strips of different colors. In the process of U.S. Pat. No.

4,250,511, the transfer film is moved at a rate fast enough to allow each of the colors to be printed in a line of pixels before the paper moves off the line of pixels. In the process of U.S. Pat. No. 5,266,272, the paper is moved back and forth to print the different color layers sequentially from the different color layers of the transfer film.

SUMMARY OF THE INVENTION

According to a first aspect of the invention, apparatus is provided for direct thermal printing on a paper web having a first thermally sensitive coating turning from a light condition to a darkened condition at temperatures above a first temperature, with the apparatus additionally providing for transfer thermal printing on the paper web. The apparatus includes a thermal printhead, a paper drive motor, a transfer film web, a film drive motor, and a number of heating elements extending within the thermal printhead. The paper drive motor moves the paper web in a first direction past the thermal printhead and in proximity with the printhead, with the first thermally sensitive coating facing the thermal printhead. The transfer film web extends between the thermal printhead and the paper web and includes a second thermally sensitive coating facing the paper web. The film drive motor moves the transfer film web in a second direction between the thermal printhead and the paper web. The heating elements are individually operable to produce a pattern of heated and darkened areas on the first thermally sensitive coating of the paper web and to transfer a pattern of material from the second thermally sensitive to the paper web from the transfer film web as the paper web is moved in proximity to the thermal printhead.

Preferably, the material from the thermally sensitive coating transferred to the paper web includes a material transmitting ambient light to a surface of the paper web and transmitting light reflected from the paper web outward while absorbing light outside a range of frequencies.

Preferably, the apparatus additionally includes control logic, causing the paper drive motor to be operated and elements within the plurality of heating elements to be driven to turn the first layer to the darkened condition to print a darkened pattern on the paper web, and also causing the paper drive motor and the film drive motor to be operated and elements within the plurality of heating elements to be driven to transfer the material from the second thermally sensitive coating to the paper web at a temperature not driving the first thermally sensitive material into the darkened condition to print a color pattern on the paper web.

The apparatus may also include a timer operating during operation of the paper drive motor and reset by operation of the film drive motor, wherein the first timer causes operation of the film drive motor following a predetermined interval of operation of the paper drive motor without operation of the film drive motor.

According to another aspect of the invention, a method is provided for printing black and color patterns on a paper web having a thermally sensitive direct printing layer darkening when exposed to a first temperature. The method includes holding the paper web against a transfer film web, having a thermally sensitive transfer layer, wherein the thermally sensitive direct printing and transfer layers are disposed adjacent one another; applying heat in a first pattern to a side of the transfer film web opposite the paper web to produce a black pattern of darkened material within the thermally sensitive direct printing layer; and applying heat in a second pattern to the side of the transfer film web opposite the paper web to cause portions of the thermally sensitive transfer layer to transfer from the transfer film web to the paper web, wherein the heat applied in the second pattern is insufficient to produce a black pattern of darken material within the thermally sensitive direct printing layer.

DETAILED DESCRIPTION OF THE INVENTION

Figure 1:
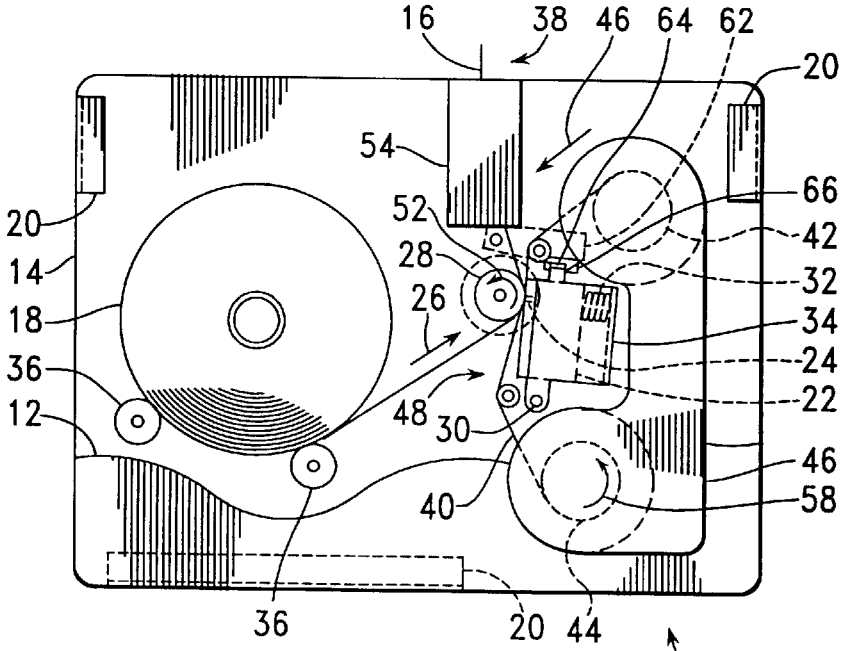
FIG. 1 is a left elevation of a printing mechanism built in accordance with the present invention, shown with a left sideplate cut away to reveal internal structure.
Figure 2:
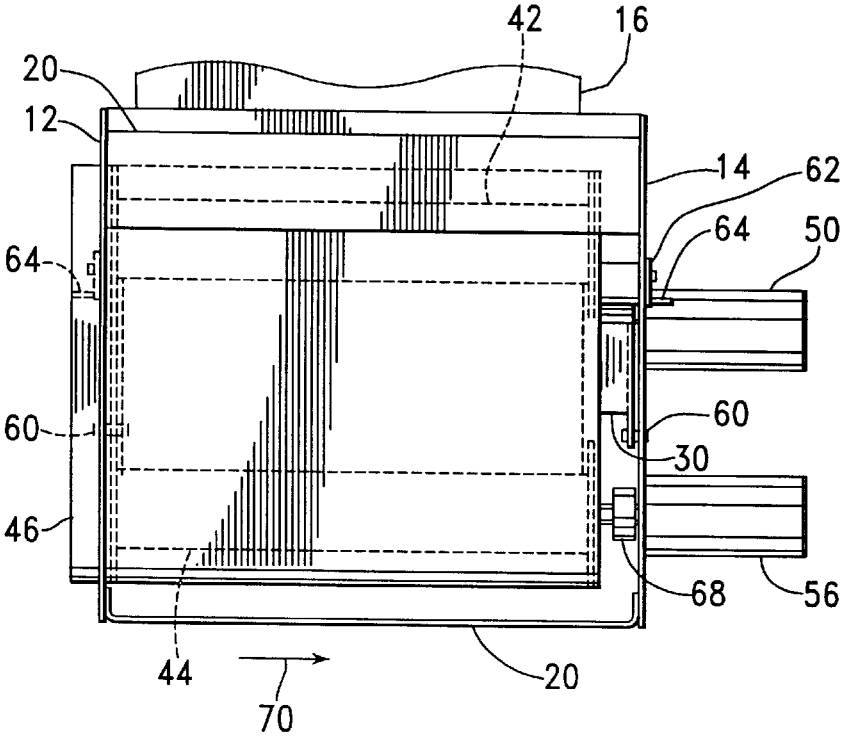
FIG. 2 is a front elevation of the printing mechanism of FIG. 1.

FIG. 1 is a left elevation of a printing mechanism 10 built in accordance with the present invention, and FIG. 2 is a front elevation thereof. The printing mechanism 10, disposed generally between a left sideplate 12 and a right sideplate 14, prints images on a paper web 16 extending from a paper roll 18. Additional frame members 20 extend between the sideplates 12, 14 to form a rigid frame structure. In FIG. 1, the left sideplate 12 is shown as mostly cut away to reveal the structure of the printing mechanism 10.

The printing mechanism 10 includes a thermal printhead 22, having a number of pixel-sized heating elements 24, extending in a line across which the paper web 16 is moved in the direction of arrow 26, being supported and driven by a rolling platen 28. The thermal printhead 22 is pivotally mounted on printhead support bracket 30 extending between the sideplates 12, 14, being held against the paper web 16 by a pair of compression springs 32 disposed between the thermal printhead 22 and tabs 34 extending inward from the sideplates 12, 14. The paper roll 18 is supported by a number of idler rollers 36, which are rotatably mounted to extend between the sideplates 12, 14 providing for rotation of the roll 18 as the web 16 is pulled therefrom.

The paper web 16 includes a thermally sensitive coating on its outer surface 38, which is the surface moved adjacent the thermal printhead 22. The thermally sensitive coating turns black when exposed to heat generated by the heating elements 24 within the thermal printhead 22. Thus, the printing process forms a black pattern on the outer surface 38 of the paper web 16 in a manner of conventional direct thermal printing.

The print mechanism 10 also includes a thermal transfer film web 40 moving between a supply roll 42 and a take-up roll 44, in the direction of arrow 45, within a cartridge 46. The thermal transfer film web 40 includes, on its outer surface 48, a color layer having a melting point and other physical properties facilitating the transfer of fragments of this layer from the film web 40 to the paper web 16 when exposed to heat generated by the heating elements 24 within the thermal printhead 22. Thus, the printing process forms a color pattern on the outer surface 38 of the paper web 16 by a thermal transfer printing process in accordance with a pattern in which heat is applied through the heating elements 24.

The paper web 16 is preferably moved by means of a paper drive motor 50 through rotation of the platen 28 in the direction of arrow 52. This movement of the paper web is synchronized with the operation of the various heating elements 24 within the thermal printhead 22 so that a desired pattern of printed data is produced and so that the paper web is fed to produce a desired pattern of space between and adjacent printed lines. In an application for printing sales receipts at a point-of-sale printer, the paper web 16 is preferably fed through a conventional paper cutting mechanism 54, which cuts across the paper web 16 to form individual receipt documents remaining joined by uncut paper tab portions which are easily torn apart.

The transfer film web 40 is preferably driven by a film drive motor 56 through rotation of the take-up roll 44 in the direction of arrow 58. In this way, the paper web 16 and the transfer film web 40 are moved between the printhead 22 and the platen 28 in opposite directions, allowing the transfer film web 40 to be intermittently moved and stopped solely by the application of electrical power to the film drive motor 56. Frictional forces exerted on the transfer film web 40 by the paper web 16 moving in the direction of arrow 26 are prevented from pulling the transfer film 40 off of the take-up roll 44 by an inability to cause rotation of the take-up roll 44 with the film drive motor 56 stopped. For example, a conventional worm and wheel speed reducer within the housing of the film drive motor 56 may be used to stop such rotation with the motor 56 stopped. In a similar manner, frictional forces exerted on the platen roll 28 through the paper web 40 by the transfer film 40 being driven in the direction of arrow 45 are prevented from causing rotation of the platen roll 28 with the paper drive motor 50 stopped. Additionally, the surface of the platen roll 28 is preferably constructed of a material having a high enough coefficient of friction with the paper web 16 that movement of the transfer film web does not cause movement of the paper web 16 relative to the adjacent surface of the platen roll.

The printhead 22 is preferably mounted in a manner allowing its separation from the platen roll 28 to facilitate replacing the paper web 16 or the transfer film web 40, both of which extend between the platen roll 28 and the printhead 22. For example, the printhead support bracket 30 is pivotally mounted to each of the sideplates 12, 14 by a pin 60, being held in an engaged position, in which the compression springs 32 hold the printhead 22 against the platen roll 28, with the paper web 16 and the transfer film ribbon 40 extending therebetween by means of a pair of latches 62. After these latches 62 are manually released, a tab 64, extending outward through a slot 66 in each sideplate 12, 14 is used to pull the printhead 22 into a position separated from the platen roll 28 by pivoting the printhead support bracket 30 about the pins 60.

The supply roll 42 and the take-up roll 44 are preferably rotatably mounted within the cartridge 46, with the take-up roll 44 engaging a coupling 68, as the cartridge 46 is slid in the direction of arrow 70, to be subsequently rotated by the film drive motor 56.

Figure 3:
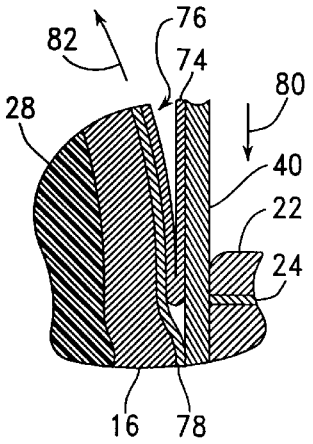
FIG. 3 is a fragmentary cross-sectional elevation of the printing mechanism of FIG. 1 showing thermal transfer printing occurring therein.

FIG. 3 is a fragmentary cross-sectional elevation of the transfer of color material from the outer layer 74 of the thermal transfer film web 40 to form a color layer 76 extending along the adjacent surface of the paper web 16. In accordance with a preferred version of the present invention, the temperature at which the color material in the color layer 76 is transferred from the film web 40 to the paper web 16 is lower than the temperature at which a thermally sensitive direct printing layer 78 on the surface of the paper web 16 turns black. Thus, the transfer process of FIG. 3 occurs with the adjacent heating elements 24 within the printhead 22 operating at a temperature that is high enough to cause the softening and transfer of color material from the outer layer 74 but still too low to cause the direct printing layer 78 on the paper web 16 to turn black. Also in accordance with a preferred version of the invention, this transfer process occurs as the thermal transfer film web 40 and the paper web 16 are moved in opposite directions between the printhead 22 and the platen roll platen roll 28, with the transfer film web moving in the direction of arrow 80, and with the paper web 16 moving in the direction of arrow 82.

Figure 4:
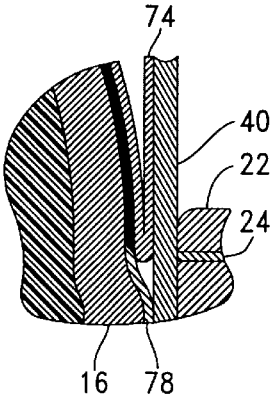
FIG. 4 is a fragmentary cross-sectional elevation of the printing mechanism of FIG. 1, showing simultaneous thermal transfer printing and direct thermal printing occurring therein.

FIG. 4 is a fragmentary cross-sectional elevation which is similar to FIG. 3, except that the adjacent heating elements 24 within the printhead 22 are driven to a temperature sufficient to cause the thermally sensitive direct printing layer 78 on the paper web 16 to turn black. The transfer of color material from the color layer 76 of the film web 40 continues as described above in reference to FIG. 3.

Figure 5:
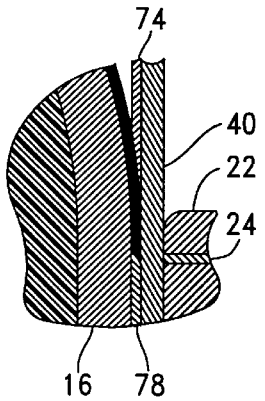
FIG. 5 is a fragmentary cross-sectional elevation of the printing mechanism of FIG.1, showing direct thermal printing occurring therein after transfer material has been work away from a film web.

FIG. 5 is a fragmentary cross-sectional elevation which is similar to FIG. 4, except that the color layer 74 has been transferred or otherwise worn away in an area 84 adjacent the heating elements 24 within the printhead 22. This condition arises when the thermal transfer film web 40 is held in place as the paper web 16 is moved. While color material from the color layer 74 is not transferred to the paper web 16 under this condition, the heating elements 24 are operated to produce a black patterned image on the paper web 16 by turning portions of the direct printing layer 78 black.

The color layer 74 is preferably transparent, like most modern color inks used in printers, so that the pattern of the underlying direct printing layer 78 is clearly visible through material from the color layer 74 after it is transferred to the direct paper web 16, with ambient light being transmitted through this material to reflect off the surface of the direct printing layer 78 and with reflections from the direct printing layer 78 being transmitted outward through the material from the color layer 74. During transmission of light through this material light frequencies outside a particular range are absorbed, while frequencies in the particular range, which may be discontinuous, are transmitted, providing the characteristic color of the material. Alternately, material from the color layer 74 may mix with material from the darkened direct printing layer 78, producing a black external appearance.

In the preferred version of the present invention, the direct printing layer 78 appears white when it has not been heated and turns black when it is heated to the proper temperature. Thus, in an area which has not been heated, the outer surface 38 of the paper web 16 appears white. In an area that has been heated to a temperature sufficient to cause the transfer of material from the color material from the color layer 74 but insufficient to cause the direct printing layer 78 to turn black, the outer surface 38 of the paper web 16 appears to be the color of the color material from the color layer 74, as ambient light is transmitted through a layer of this color material, reflected from an underlying white surface, and again transmitted through this layer of color material. In an area that has been heated to a temperature sufficient to cause the direct printing layer 78 to turn black, the outer surface 38 of the paper web 16 appears to be black, whether or not color material is transferred to the paper web 16. Where a layer of color material is present over a blackened portion of the direct printing layer 78, ambient light is absorbed by the blackened layer instead of being reflected through the color layer, so that the area appears to be black.

The color layer 74 may be a conventional thermal-wax transfer layer, in which the pigment is mixed with a binder, such as a wax, which, upon being heated by the heating elements 24 within the printhead 22, melts to be transferred with the pigment to the paper. Then, on the cool paper web 16, the binder hardens, holding the pigment in place. Alternately, the color layer 74 may be a conventional dye-sublimation layer, in which a portion of the color layer 74 is turned into a gas by heat from the heating elements 24, with the gas cooling into a solid on the cool paper web 16. While the example of FIG. 4 shows all of the color layer 74 being transferred to the paper, proper operation can also occur with a partial transfer of the color layer.

For example, when it is desirable to attract attention to a particular portion of a document printed using the printing apparatus 10, this particular portion of the document may be printed in the color of the color layer 74, while other portions of the document are printed in black. For example, the portion to which attention is to be drawn by be printed in red. Alternately, all data may be printed in black, with the portion to which attention is to be drawn being highlighted with a colored background, such as a yellow rectangular solid area around the data within this portion. In the exemplary application of printing sales receipts, this process may be used to draw particular attention to the total price, the change to be returned, relative savings on certain items, advertising material, or a group of these elements.

Figure 6:
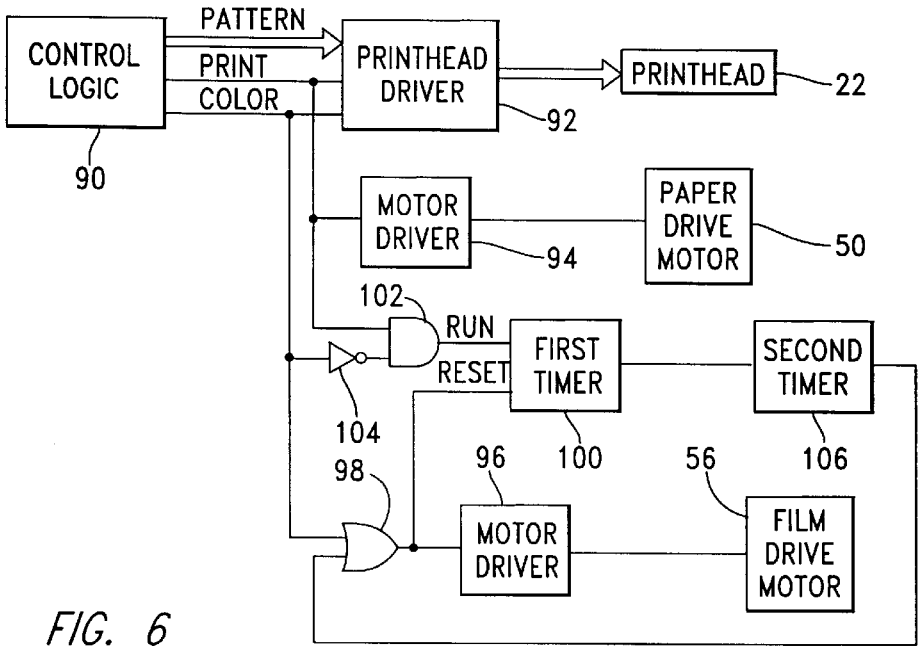
FIG. 6 is block diagram showing devices controlling operation of the printing mechanism of FIG. 1.

FIG. 6 is a block diagram of various devices controlling operation of the printing mechanism 10, shown in FIG. 1. The control logic circuits 90 generate a number of PATTERN signals describing the pattern to be printed, which are transmitted to the printhead driver circuit 92, along with a PRINT signal indicating that printing is to occur and a COLOR signal indicating when the printing is to be in the color of the color layer 74 of the film web 40. The control logic 90 may be implemented, for example, using a microprocessor within a printer including the printing unit 10 or within a computing system connected to a printer including the printing unit 10.

The PRINT signal is transmitted both to the printer driver circuit 92 and to a motor driver circuit 94 controlling operation of the paper drive motor 50. The exact nature of the motor driver circuit 94 depends on the type of the motor 50 being driven, which may be, for example, a stepper motor or a permanent magnet motor. Since paper is driven whenever the PRINT signal is active, the PRINT signal can be used to provide for blank sections and margin areas of the document as well as printed areas.

The COLOR signal is provided as an input to a motor driver circuit 96 through an OR gate 98 to operate the film drive motor 56 when the pattern is to be printed in the color of color transfer material 74 of the film web 40. When printing occurs with the COLOR signal active, the printhead driver circuit 92 drives the heater elements 24 within the printhead 22 to produce a pattern of these elements 24 heated to a first temperature causing the transfer of the transfer material 74 to the paper web without causing the direct printing layer 78 to turn black. When printing occurs with the COLOR signal inactive, the printhead driver circuit 92 drives the heater elements 24 to produce a pattern of these elements heated to a second temperature, higher than the first temperature, causing the direct printing layer 78 to turn black, and causing the simultaneous transfer of the transfer material 74, as long as such material is available.

In accordance with a preferred version of the present invention, a means is also provided for causing movement of the transfer film web 40 after a first predetermined time is spent printing without movement of this web 40, in order to prevent the web 40 from being worn through by the process of direct printing. In the example of FIG. 6, this first predetermined time is established through the operation of a first timer 100, which runs when the output of an AND circuit 102. The PRINT signal is provided as a first input to the AND circuit 102, while the COLOR signal is inverted within an invertor 104 to form the second input to the AND circuit 102. Since wear is cumulative over time, the operation of the first timer 100 is stopped but held at a level reached during its operation when the output of the AND circuit 102 becomes inactive. When the first predetermined time is reached, the output of the first timer becomes active, causing a second timer 106 is started to run for a second predetermined time. The output of the second timer 106 is provided as a second input to the OR gate 98, so that the film drive motor 56 is run to expose an unworn portion of the film strip 40 to the printing process. The output of OR gate 98 is also provided as a RESET signal to the first timer 100, so that whenever the film drive motor 56 is operated, the first timer 100 is reset to begin measuring a new time of movement of the paper web 16 without movement of the film web 40. The timers 100, 106 are implemented, for example, using special-purpose timer circuits or by using a subroutine operating within a microprocessor to count clock pulses. Alternately, the first timer may count revolutions of the paper drive motor 50, while the second timer counts revolutions of the film drive motor 56.

In some instances it may be desirable to print a black pattern using the direct printing layer 78 and a color pattern using the transfer layer 78 simultaneously, so that the color pattern is transversely disposed from the black pattern on the paper web 16. When this is done, the various heating elements 24 are driven to the appropriate temperatures to create this effect, and the film drive motor is operated to expose a new portion of the transfer layer 78 to the printing process.

When compared to prior art methods for thermal printing of two colors, the present invention has the advantages of not requiring the use of a relatively expensive paper web having a thermally sensitive layer turning different colors at different temperatures or alternately of requiring the use of a two-color thermal transfer film for all printing. The single-color transfer film required for use in the present invention is used very sparingly in a typical application, being moved to present new material to the printing process only when color printing is required or as necessary to prevent the backing film from wearing through.

While the present invention has been described in its preferred form or embodiment with some degree of particularity, it is understood that this description has been given only by way of example, and that numerous changes in the details of fabrication and use, including the combination and rearrangement of parts and process steps, may be made without departing from the spirit and scope of the invention.

What is claimed is:

1. Apparatus providing for direct thermal printing on a paper web having a first thermally sensitive coating turning from a light condition to a darkened condition at temperatures above a first temperature, wherein said apparatus additionally provides for transfer thermal printing on said paper web, wherein a material from said thermally sensitive coating transferred to said paper web includes said material transmitting ambient light to a surface of said paper web and transmitting light reflected from said paper web outward while absorbing light outside a range of freguencies, and wherein said apparatus comprises:

a thermal printhead;

a paper drive motor moving said paper web in a first direction past said thermal printhead and in proximity with said printhead, with said first thermally sensitive coating facing said thermal printhead;

a transfer film web extending between said thermal printhead and said paper web including a second thermally sensitive coating facing said paper web;

a film drive motor moving said transfer film web in a second direction between said thermal printhead and said paper web; and a plurality of heating elements extending within said thermal printhead adjacent said transfer film web, individually operable to produce a pattern of heated and darkened areas on said first thermally sensitive coating of said paper web and to transfer a pattern of material from said second thermally sensitive coating to said paper web from said transfer film web as said paper web is moved in proximity to said thermal printhead.

a control logic controlling operation of said paper drive motor, said film drive motor, and said heating elements, wherein said control logic causes said paper drive motor to be operated and elements within said plurality of heating elements to be driven to turn said first layer to said darkened condition to print a darkened pattern on said paper web, and said control logic causes said paper drive motor and said film drive motor to be operated and elements within said plurality of heating elements to be driven to transfer said material from said second thermally sensitive coating to said paper web at a temperature not driving said first thermally sensitive material into said darkened condition to print a color pattern on said paper web, and a timer operating during operation of said paper drive motor and reset by operation of said film drive motor, wherein said first timer causes operation of said film drive motor following a predetermined interval of operation of said paper drive motor without operation of said film drive motor, wherein said plurality of heating elements transfer said pattern of material from said second thermally sensitive coating to said paper web at a temperature below a temperature at which said first thermally sensitive coating darkens.

2. The apparatus of claim 1, additionally comprising a platen extending adjacent said plurality of heating elements, wherein said paper web and said film web are held together between said platen and said thermal printhead.

3. The apparatus of claim 2, wherein said paper drive motor and said film drive motor move said paper web and said film web in opposite directions between said platen and said thermal printhead, and said film drive motor holds said transfer film web in place against frictional forces applied by said paper web when said paper web motor is operated without operation of said film drive motor.

4. The apparatus of claim 2, wherein said platen comprises a roll driven in rotation by said paper drive motor.

5. The apparatus of claim 2, additionally comprising a supply roll and a take-up roll driven in rotation by said film drive motor to move said transfer film web from said supply roll to said take-up roll.

* * * * *